US006413014B1

(12) United States Patent
Melin

(10) Patent No.: US 6,413,014 B1
(45) Date of Patent: Jul. 2, 2002

(54) DAMMING DEVICE FOR ERECTING A LIQUID-DAMMING PROTECTIVE BANK

(76) Inventor: Sigurd Melin, Veda, Näsviken S-820 64 (SE)

( * ) Notice: Subject to any disclaimer, the term of this patent is extended or adjusted under 35 U.S.C. 154(b) by 0 days.

(21) Appl. No.: 09/423,281

(22) PCT Filed: Mar. 26, 1998

(86) PCT No.: PCT/SE98/00547

§ 371 (c)(1),
(2), (4) Date: Nov. 8, 1999

(87) PCT Pub. No.: WO98/51865

PCT Pub. Date: Nov. 19, 1998

(30) Foreign Application Priority Data

May 12, 1997 (SE) ..... 9701742

(51) Int. Cl.[7] ..... E02B 7/00
(52) U.S. Cl. ..... 405/107; 405/113; 405/114
(58) Field of Search ..... 405/15, 21, 30, 405/31, 87, 107, 112, 113, 114, 25, 28, 33

(56) References Cited

U.S. PATENT DOCUMENTS 1,033,988 A * 7/1912 Coburn ..... 405/112
1,535,792 A * 4/1925 Ruggles ..... 405/21
2,128,657 A * 8/1938 Madaras ..... 405/113
4,136,995 A 1/1979 Fish
4,362,432 A * 12/1982 Conover ..... 405/15
4,498,805 A * 2/1985 Weir ..... 405/31
4,502,816 A * 3/1985 Creter, Jr. et al. ..... 405/30
4,818,141 A * 4/1989 Rauch ..... 405/30
4,913,595 A * 4/1990 Creter, Jr. et al. ..... 405/30
4,921,373 A 5/1990 Coffey
5,470,177 A * 11/1995 Hughes ..... 405/107
5,605,416 A * 2/1997 Roach ..... 405/21
5,655,851 A * 8/1997 Chor ..... 405/31
5,697,736 A * 12/1997 Veazey et al. ..... 405/21
5,899,632 A * 5/1999 Martin ..... 405/21

* cited by examiner

*Primary Examiner*—Robert E. Pezzuto
*Assistant Examiner*—Alexandra K. Pechhold
(74) *Attorney, Agent, or Firm*—Birch, Stewart, Kolasch & Birch, LLP

(57) ABSTRACT

A damming device for forming a liquid-damming protective bank comprises at least one first board (1), in the active state laying, intended to be urged by the liquid against the surface and thereby anchoring the device, as well as at least a second board (2), in the active state up-right, intended to dam the liquid. There are liquid-draining means (5) on the bottom side of the anchoring board (1). Devices (9, 9') act between the two boards (1, 2) with the purpose of inhibiting tilting of the damming board (2) from the active position in the direction towards the dry the side, when liquid simultaneously affects the anchoring board (1) with a vertical force and the damming board (2) with a horizontal force.

6 Claims, 5 Drawing Sheets

DAMMING DEVICE FOR ERECTING A LIQUID-DAMMING PROTECTIVE BANK

TECHNICAL FIELD OF THE INVENTION

Figure 1:
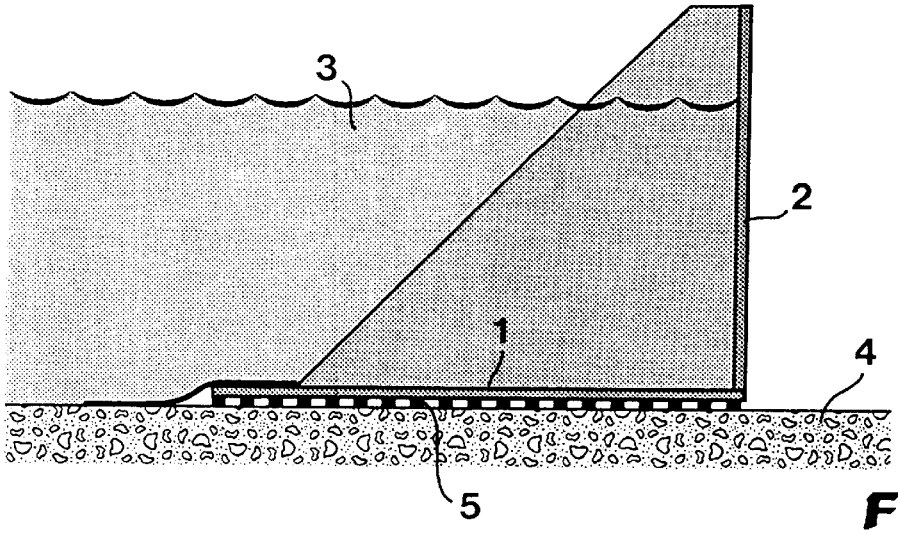

This invention relates to a damming device intended for forming a liquid-damming protective bank, which comprises components with the purpose of holding the device anchored against a surface, more precisely by friction action as a consequence of a vertically directed hydraulic pressure urging the device against the surface, as well as counteracting that liquid streams from a wet side or flood side to a dry side, means being provided between the surface and the actively acting protective bank for the purpose of draining away flood liquid which possibly leaks in under the device from the flood side so as to hold the surface on the bottom side of the device extending from the edge of the draining means being closest to the flood side to the dry the side at or close to atmospheric pressure with the purpose of achieving a maximum pressure difference in relation to the hydraulic pressure holding the device urged against the surface.

PRIOR ART

A damming device of the kind generally described above is previously known by SE 9500795-1. More precisely, this patent discloses a mobile device, the liquid-damming component of which is constituted by a flexible casing that may be expanded by being filled with water or air. An advantage of this device is that it may be stored in a collapsed state in which it occupies a minimum of space in conjunction with storing and transportation, and thereafter it may be expanded on location in a fast and simple way in areas where there is a risk for a flood. Furthermore, the device is easily and flexibly pliable, which means that the device may advantageously be used in order to dam water on soft and uneven surfaces, which may have inferior bearing capacity. In practice, the device also includes a relatively wide skirt connected to the flood side of the casing, which skirt forms the anchoring component of the device. By the fact that this skirt is wide, a reliable anchoring of the device is obtained. However, depending on the field of use, the known damming device is also associated with certain disadvantages. Thus, a disadvantage is that the flexible casing, made of plastic or rubber, runs the risk of being punctured at careless handling. Another disadvantage is that the casing occupies a considerable width besides the skirt. In case the casing would be given a large height with purpose of counteracting floods having high water lines, the total width of the device would be considerable. For this reason the applicability of the device is in practice limited to relatively low water levels, for instance within the range of 0,5–1,5 m. At higher water levels, the device would require too large a total width in order to be able to be used successfully for instance inside densely built-up areas, in particular built-up areas with narrow streets.

In addition to the above-mentioned damming device, also mechanical constructions of many different embodiments (see for instance U.S. Pat. Nos. 898,984, 4,136,995, 4,692,060, 4,921,373 and 5,470,177) are used for flood control purposes. These previously known mechanical flood control devices are based on the fact that the power that the water or liquid pressure exert on them should, by support legs or other mechanical elements, be linked to the ground. However, this implies that the ground has a good bearing capacity. This is something which far from always is the case in the practical flood situation. Theoretically, the mechanical damming devices may be erected to a high height, but this requires that the ground is strong and that the constructions are dimensioned very solidly. It can generally be said that the known, mechanical damming devices, at least theoretically, have a larger damming ability than the device known through SEE 9500795-1 that works with a flexibly, expandable casing. On the other hand, the last-mentioned device has a more reliable anchoring ability than the mechanical damming devices.

OBJECTS AND FEATURES OF THE INVENTION

The present invention aims at obviating the above-mentioned disadvantages and shortcomings of the above-related main categories of damming devices and at creating an improved damming device. Thus, a primary object of the invention is to create a damming device that, for a given total width, is capable of controlling high water levels. A further object is to create a device which does not run the risk of being punctured and thereby collapse in an active state. Still another object is to create a damming device which is robust in its active, liquid damming state, as well as constructionally simple and thereby cheap to manufacture. The device should furthermore be simple to transport and handle in conjunction with the erection of a protective bank.

According to the invention, at least the primary object is attained by the features defined in the characterizing clause of claim 1. Preferred embodiments of the invention are furthermore defined in the dependent claims.

BRIEF DESCRIPTION OF THE APPENDED DRAWINGS

Figure 2:
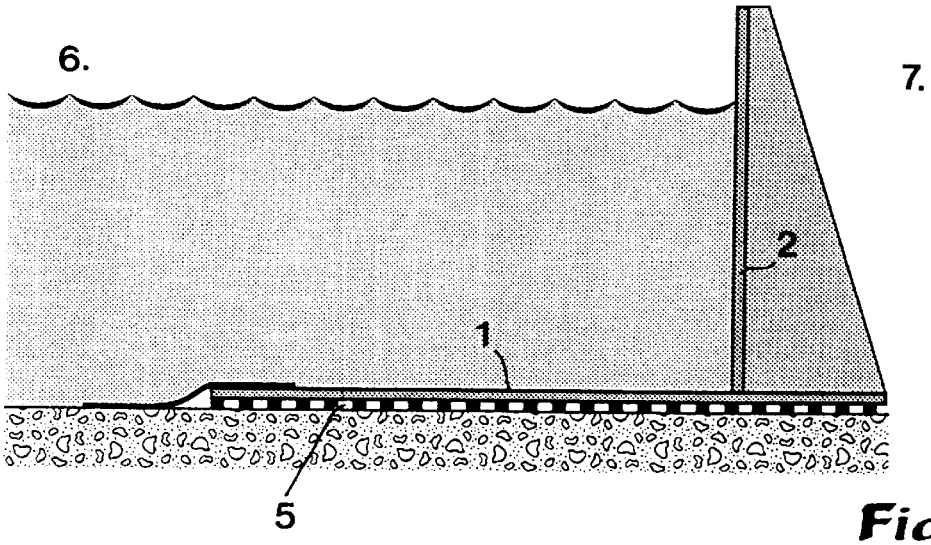
Figure 3:
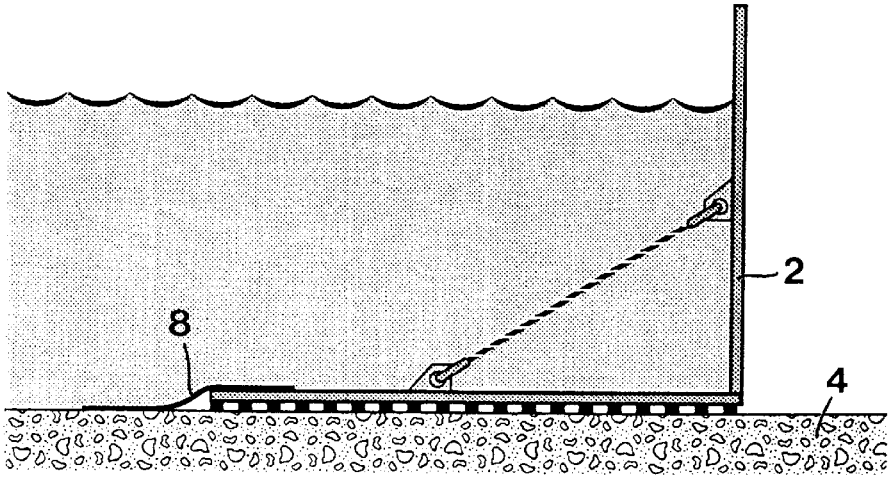
Figure 4:
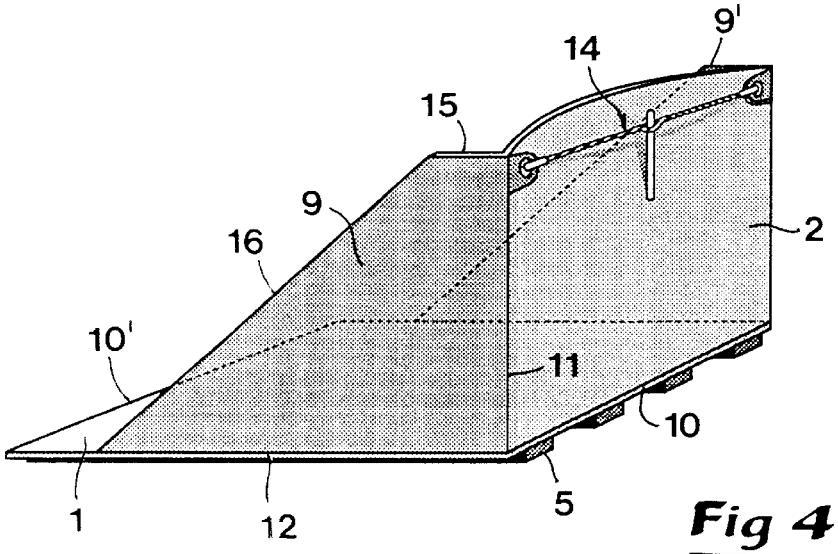
Figure 5:
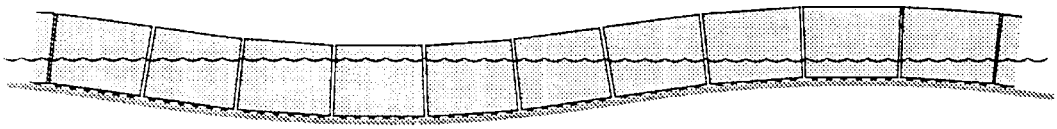
Figure 6:
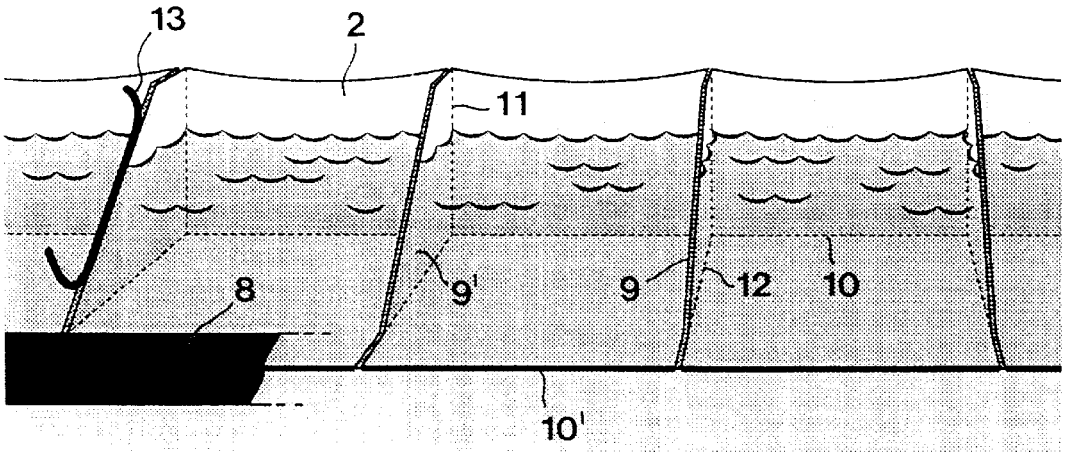
Figure 7:
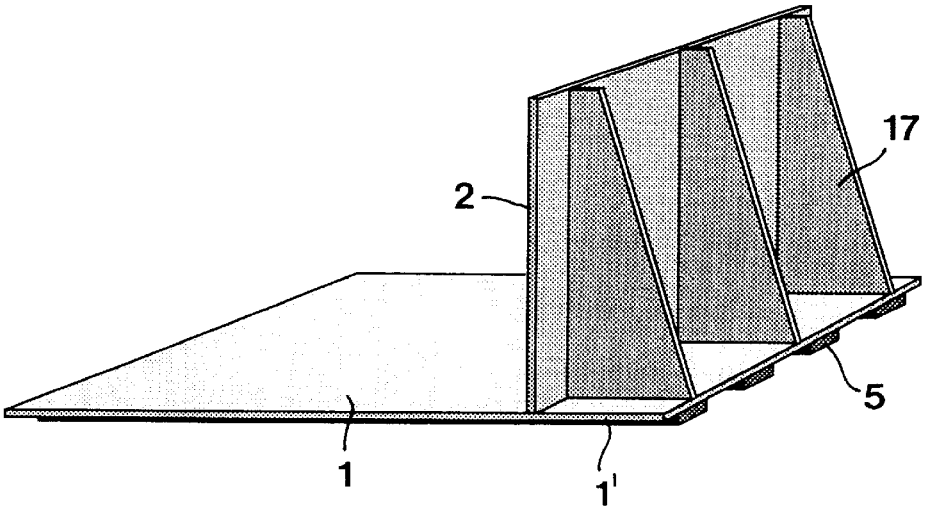
Figure 8:
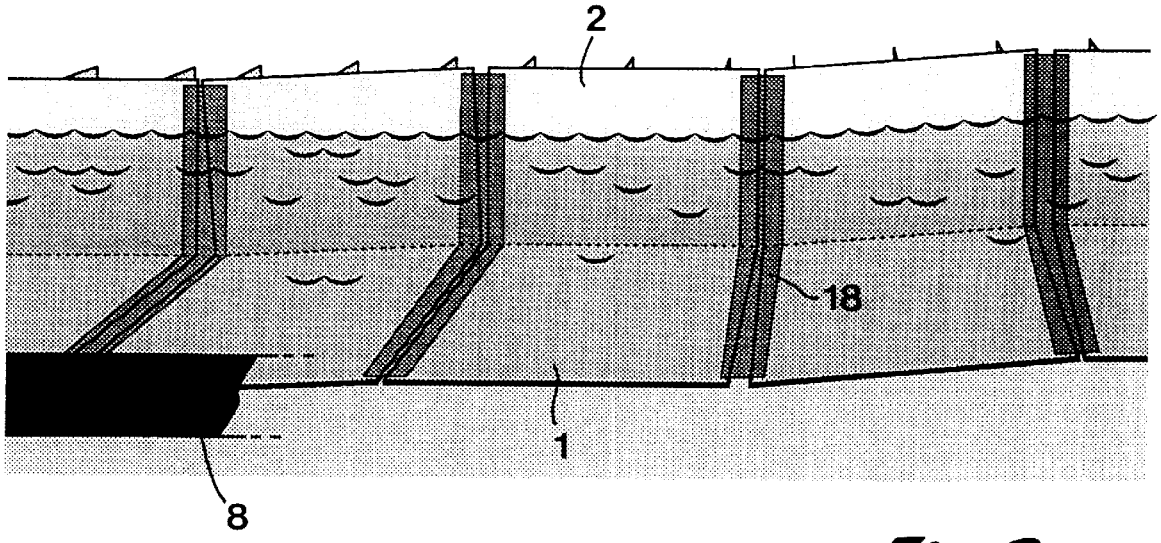
Figure 10:
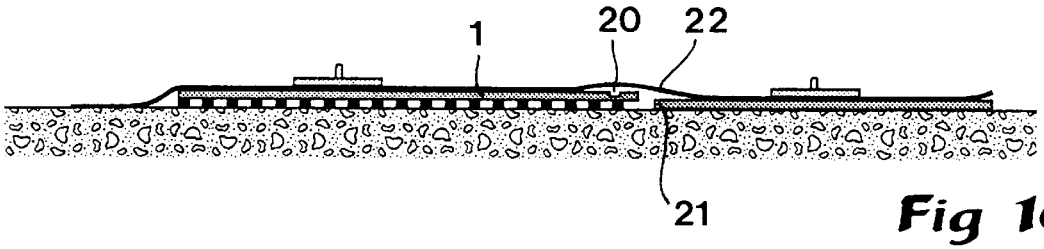
Figure 9:
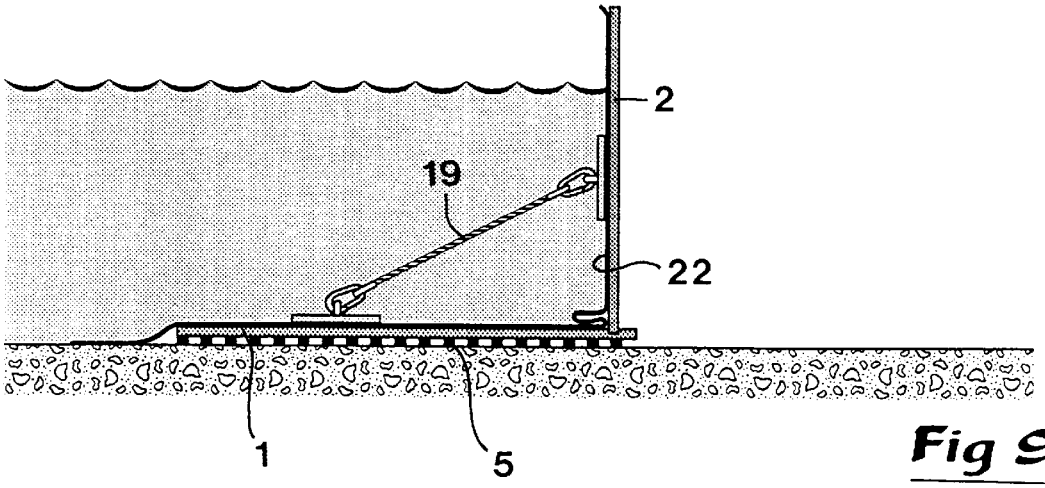
Figure 11:
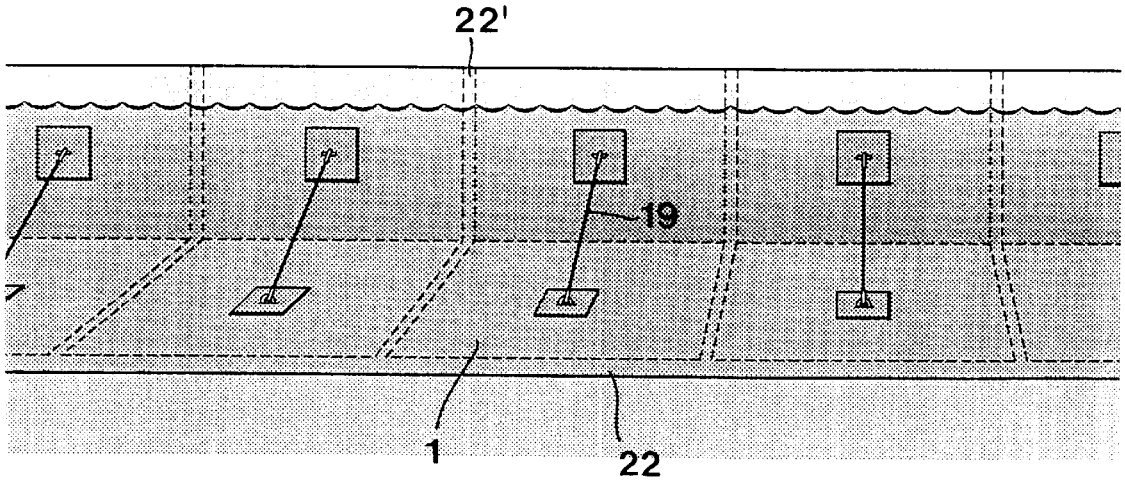
Figure 12:
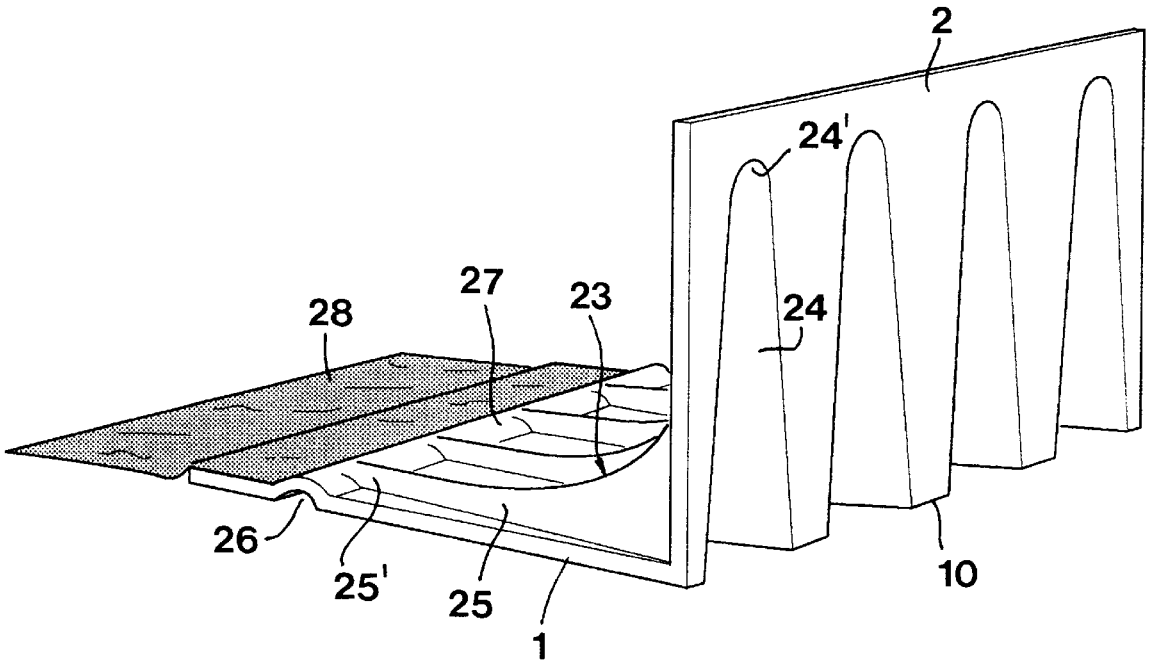

In the drawings:

FIGS. 1–3 are schematic cross-sections through three different main variants of the damming device according to the invention, FIG. 4 is a perspective view showing the same damming device as in FIG. 1, although regarded from the dry side of the device, FIG. 5 is a front view showing how a plurality of devices according to FIG. 4 are put together to a coherent protective bank situated on an uneven surface, FIG. 6 is a perspective view showing a portion of the protective bank according to FIG. 5 viewed from the flood side, FIG. 7 is a perspective view of the same alternative embodiment of the device shown in FIG. 2, said device being viewed from the dry side, FIG. 8 is a perspective view which shows, from the flood side, a portion of a protective bank composed of devices according to FIG. 7, FIG. 9 is a cross section showing the same device as in FIG. 3, more precisely in an active, liquid-damming state, FIG. 10 is an analogous cross section showing the components of the device before the final assembly, FIG. 11 is a perspective view viewed from the flood side showing a protective bank composed of devices according to FIGS. 9 and 10, and FIG. 12 is a perspective view of an additional alternative embodiment of the invention.

DETAILED DESCRIPTION OF PREFERRED EMBODIMENTS OF THE INVENTION

FIGS. 1–3 illustrate three different embodiments of the invention, which all have in common that they include a first, laying board 1 and a second up-right board 2. Of these boards, the first-mentioned one has the purpose of anchoring the device in its entirety, more precisely by being urged against the ground or another surface 4 by a liquid designated 3, in particular water, while the second board 2 has to the purpose of damming the liquid mass. Common for these three embodiments is furthermore that the laying board 1 on its bottom side has means 5 for draining away water which possibly leaks in under the board. The wet side or flood side of the damming device is generally designated 6, while the dry side is designated 7. The draining means 5 on the bottom side of board 1 may advantageously be in the form of a layer which extends along the entire width of the board, i.e. from the flood side to the dry side, although it is also conceivable to limit the width of the draining layer to only a part of the entire width of the anchoring board. In practice, the draining layer may be achieved in several different ways. The layer may, for instance, consist of a profiled, perforated or porous board which is either permanently attached to the bottom side of the anchoring board or loosely applied between the board and the ground. The layer may also consist of a plurality of laths, cross bars, legs or other spacing elements. In this connection it should also be mentioned that the draining layer or board may be made wedge-shapedly narrowing instead of being equally thick from a maximum height on the dry side to a minimal or unnoticeable height in the area of the wet side.

In all embodiments according to FIGS. 1 to 3, a fabric or a similar flexible band element 8 which abuts against the ground 4 as well as against the top side of the anchoring board 1 is furthermore shown. This fabric may be in the form of a separate unit which may be put over several anchoring boards following after each other or be applied on each individual board and have a larger length extension than the actual board in order to permit overlapping vis-à-vis an adjacent board.

A characteristic feature of all the embodiments of the invention is furthermore that devices act between the two boards 1, 2 with the purpose of inhibiting tilting of the up-right, liquid-damming board from the active position in the direction towards the dry side, when the liquid simultaneously acts on the anchoring board with a vertical force and the damming board with a horizontal force.

In the following description the term "width" is used to describe the extension of the anchoring board between the edge of the flood side and the edge of the dry the side, while the term "length" or "axial extension" is used to describe the extension of the anchoring board in a 90° angle to the width dimension. This terminology, however, does not limit the dimensions of the anchoring board. In practice therefore, the anchoring board may have a larger width than length.

Reference is now made to FIGS. 4 to 6, which in combination with FIG. 1 illustrate a first, shovel-like embodiment of the damming device according to the invention. In this case, those devices that have the purpose of holding the damming board 2 in an upright position, consist of two tensile force carrying connection devices which extend between the wet side of the damming board and the anchoring board 1. More precisely, these connection devices consist of end surfaces 9, 9' which extend along the two opposite, transversal edges of the board 1 and the two opposite, up-right edges of the damming board 2. The boards 1, 2 are interconnected in a liquid-proof way along the connection line 10 which extends along the lower edge of the damming board and the top side of the anchoring board. A liquid-proof connection also exists along the lines 11, 12 which connect the individual end surface to the damming board 2 and the anchoring board 1, respectively. In practice the boards 1 and 2 as well as the end surfaces 9, 9' may be made of plates which are united to each other by means of welding. In this context, however, it should be pointed out that the end surfaces 9, 9' also may be made of an elastically flexible material. However, in practice it is preferred to make the individual end surface of a shape-stiff material like the damming and anchoring boards and to stiffly unite the end surface with these boards while forming a construction which is shovel-like and which, in an active state, opens towards the flood side.

For forming a continuous protective bank of the type shown in FIGS. 5 and 6, a plurality of such, shovel-like damming devices are placed side-by-side adjacent to each other. In order to achieve sealing of adjacent damming devices in the assembled protective bank, advantageously cross-section-wisely substantially U-shaped sealing strips 13 (or bands) are arranged, which are applied on the free edges of adjacent end surfaces in order to bridge possible spaces therebetween.

In order to facilitate erection of damming devices on uneven grounds of the type which is indicated in FIG. 5, the damming board 2 may in a flat, tension-free state have oblique edges which mutually diverge in the direction upwards. By the connection thereof to the end surfaces 9, these edges also keep the end surfaces in a state diverging from each other in the direction upwards, which allows several damming devices to be tiled in each other. A loading or tightening mechanism generally designated 14 extends between the side edges of the damming board 2 which has the purpose of, when required, reducing the distance between the upper parts of the side edges and thereby those of the end surfaces, more precisely by bringing the damming board 2 to sag in the direction towards the flood side, as is apparent from FIG. 4. Suppose that the angle between the individual end surface and the appurtenant anchoring board should be variable within the range of 88–92° in order to enable obliquity of the anchoring board of an adjacent device within the range of +2° to −2° relative to the horizontal plane. In this case the device may be made with end surfaces, each one of which having an angle of, for instance, 93° relative to the anchoring board. When such a prefabricated device has been put in place, the desired angle of inclination may be achieved by reducing the length of the loading mechanism 14, the damming board 2 in the area of the upper edge thereof sagging in the direction inwards towards the flood side. This not only leads to the advantage that the bottom of the ready-made protective bank may be adjusted to uneven ground but also that the damming board receives a better geometry force carrying-wise than if it were plane.

In other respects, it may be mentioned that the end surfaces 9, 9' in the shown embodiment have been formed with an upper edge 15 which is horizontal as well as an edge 16 leaning downwardly therefrom which ends at a distance from the rear edge 10' of the board 1. By the fact that the end surfaces are, in this manner, terminated at a certain distance from the edge 10', room is given for the above-mentioned sealing fabric or band 8, whereby this band may simultaneously cover several sealing devices subsequently following each other in the ready-made protective bank. In order to decrease the effect of possible waves and/or streams in the dammed water mass, the devices should, when required, be able to be provided with particular boards (not shown) which rest against or are connected to the leaning edge portions of the end surfaces 9, 9'. Such an additional board may be made either with the same axial extension as the individual damming device or be longer so as to cover several devices positioned adjacent to each other. However, the additional boards have to allow water to pass into and out of the space between the end surfaces, preferably through a gap between the lower edge of the additional board and the anchoring board 1.

In case a protective bank needs to be erected with angles between different sections, particular damming devices may be used, the bottom boards of which having non-parallel cross edges 12. With four perpendicular corner devices and a number of standard devices even a temporary pool may be created on the desired surface.

Reference is now made to FIGS. 7 and 8 which in combination with FIG. 2 show a second, alternative embodiment of the invention. In this case, the devices which have the purpose of holding the damming board 1 in place in an upright position consist of one or more compressive force carrying support devices 17 arranged to act between the dry side of the damming board 2 and a portion 1' protruding from the damming board of the anchoring board 1. In practice, these support devices may advantageously consist of up-right boards which in an active state protrude at an angle, for instance a perpendicular angle, from the dry side of the damming boards 2 and upwards from the top side of the protruding board portion 1'. Although the support boards 17 may be firmly connected to at least one of the boards 1, 2, they may also be flexibly connected to one of the boards, for instance via hinges which permit folding of the boards, for instance towards the dry side of the damming board in order to reduce the space of the support boards in conjunction with storage and transportation. Instead of boards, thin legs or bars which carry compressive force in the area between the dry side of the damming board and the board portion 1' may also be used.

As may be seen in FIG. 8, the spaces or openings which arise between adjacent damming devices in a continuous protective bank may be sealed by means of a separate sealing member 18, for instance a strip or fabric, an angled plate or the like. By the fact that the sealing member partly has an air gap on the bottom side thereof it will be held urged in the desired position by the water pressure acting from above. The member is made sufficiently stiff so as to be able to bridge also wider openings. In case the member is made of a stiff material, it may advantageously have sealing fillets along its long sides or foam rubber on its bottom side. As an additional security, in particular at low water levels, the sealing member may also be fixed in a mechanical way, for instance be clamped by a resilient holder, be fitted below hooks, etc.

In FIG. 8 the joint being furthest to the left is shown between adjacent damming devices situated above a hallow in the ground, while the next opening is above a ridge. The opening between adjacent anchoring boards is in both cases equally wide, but the opening between the damming boards will in one of the cases diverge and in the other case converge. The three damming devices shown furthest to the right in FIG. 8 stand on plane ground, but are angled in relation to each other in the ground plane, the two joints between the damming boards narrowing wedge-shapedly in opposite directions. Thus, the width of the openings between anchoring boards varies here, while the openings between adjacent damming boards become parallel.

Reference is now made to FIGS. 9–11 which in combination with FIG. 3 show a third embodiment of the damming device according the invention. In this case, the tensile force carrying connection device between the boards 1, 2 consists of a long narrow element 19 which at one end is attached to the wet side of the damming board, more precisely at a distance from the lower edge of this board, and at an opposite end is attached to the anchoring board, more precisely at a distance from the damming board. In practice, the connection element 19 may consist of a wire, rod or the like, which is coupled to suitable fastenings. In this embodiment, the boards 1, 2 constitute separate components which may be interconnected when the need arises, i.e. when a protective bank is to be erected and the two boards are to fulfil their purposes. Although connection of the two boards may be realised in many different ways, FIGS. 9 and 10 show how the anchoring board 1 in the area of its dry side has a groove 20 in which the lower edge 21 of the damming board 2 may be applied. In other words, the lower edge 21 of the damming board forms a male-like element and the groove 20 a seat for this male element. A continuous, liquid-proof fabric 22 is applied against and fixed to the inside of the damming board 2 and the top side of the anchoring board 1, a flexible portion of the fabric extending between the separated boards. When the boards are mounted together, this fabric folds in the transition between the boards without loosing its liquid-sealing ability.

As may be seen in FIG. 11, the fabric 22 may advantageously be common for adjacent damming devices in the form of boards 1, 2 co-acting in pairs. Thus, in the boundary zone between two adjacent damming devices, a flexible fabric portion 22' will extend admitting a certain mobility between the different boards. Along the long side edge of the ready-made erected protective bank, which is directed towards the flood side, the fabric 22 has a larger width than the anchoring boards 1, a projecting portion of the fabric sealing against water leakage under the anchoring board.

In FIG. 12 an additional embodiment is shown according to which a number of tensile force carrying connection devices between the damming board 2 and the anchoring board 1 consist of beads generally designated 23. Each such bead 23 is formed as a continuous and cross-section-wise arched member composed of a board portion 24 outwardly cambered inwards from the damming board 2 as well as a board portion 25 outwardly cambered upwards from the anchoring board 1. In practice, the arched board portion 24 may extend along the major part of the height of the damming board 2 (or even the entire height) at the same time as the corresponding board portion 25 of anchoring board 1 extends along the major part of the width thereof. The board portion 24 narrows in the direction towards the upper end 24' thereof. In an analogous way, the board portion 25 narrows in the direction towards an end portion 25' which is distanced from the damming board 2. The narrowing shape of each board portion respectively is made along the side extension as well the down extension. By the fact that the vertical and horizontal board portions of the bead narrow, several damming devices may be tiled in each other.

In the example according to FIG. 12, the damming device includes four mutually parallel beads 23. The free ends of the board portions 25 which are included in said beads mouth in a common collection channel 26 which is delimited by a board portion designated 27 which extends axially between the two opposite side edges of the anchoring board 1. Most suitably the channel 26 extends parallel to the damming board 2. Adjacent to the channel-limiting board portion 27 a fabric or skirt 28 is arranged which, as previously described, forms a sealing against the ground. In case water would leak in under the skirt 28 and the rear, plane portion of the board 1, the water will be distributed via the channel 26 to one or more of the channels which are defined by the arched beads and drained out on the dry side of the damming device. In other words, the arched beads 23 constitute not only tensile force carrying connection devices between the two boards 1 and 2, but also a draining means.

FEASIBLE MODIFICATION OF THE INVENTION

The invention is not solely restricted to the embodiments described above and shown in the drawings. Thus, only one, suitably centrally located, stiff or flexible device having a large surface extension may be used as tensile force carrying device instead of two (stiff or flexible) end surfaces at opposite cross edges. Furthermore, it is conceivable to make the shovel-like embodiment according to FIGS. 4–6 in such a way that the boards and end surfaces respectively may be folded in relation to each other so as to facilitate storing and transportation.

What is claimed is:

1. A damming device for forming a barrier between a wet or flood side and a dry side of said device, comprising:

an anchoring board for resting on a surface in a generally horizontal orientation, said anchoring board having top and bottom sides, and side, front and rear edges;

hydrostatic anchoring means associated with said board for anchoring said device to said surface by hydrostatic pressure, said anchoring means comprising in combination a barrier for limiting liquid seepage from said flood side underneath said anchoring board and draining means for maintaining a pressure differential between the hydrostatic pressure acting on said top side of said anchoring board and a substantially atmospheric pressure acting on the bottom side thereof by draining liquid away from the underside of said anchoring board for discharge at said dry side, said draining means comprising one or more channels at said lower side of said anchoring board;

a liquid impervious damming board fastened to said anchoring board for orientation in an upright position for retaining said liquid on said wet side and preventing passage of said liquid from said wet side to said dry side, said damming board having upper, lower and side edges;

at least one connecting means between said anchoring board and damming board for holding said damming board in said generally upright position;

wherein said at least one connecting means consist of one or more tensile force carrying connection devices which extend between the wet side of the damming board and the anchoring board, wherein said anchoring board and said damming board are interconnected in a liquid-proof way along a connection line which extends between a lower edge of the damming board and the top side of the anchoring board, and wherein the one or more tensile force carrying connection devices each comprise a generally plate-like web;

at least two of said tensile force carrying connection devices comprising two end surfaces each one of which includes a top part and an upright edge connected in a liquid-proof way to the damming board along said upright edge, as well as the anchoring board along a laying edge, all while forming a construction which is shovel-like and which, in an active state, opens towards the wet side;

wherein the damming board in a plane, tension-free state has oblique side edges which mutually diverge in an upward direction and which are connected to said end surfaces whereby said end surfaces are maintained in a state diverging from each other in an upward direction, and that a loading mechanism extends between the side edges of the damming board for reducing, when required, the distance between the side edges and thereby the top parts of the end surfaces by causing the damming board to bow convexly towards the wet side.

2. A damming device for forming a barrier between a wet or flood side and a dry side of said device, comprising:

an anchoring board for resting on a surface in a generally horizontal orientation, said anchoring board having top and bottom sides, and side, front and rear edges;

hydrostatic anchoring means associated with said board for anchoring said device to said surface by hydrostatic pressure, said anchoring means comprising in combination a barrier for limiting liquid seepage from said flood side underneath said anchoring board and draining means for maintaining a pressure differential between the hydrostatic pressure acting on said top side of said anchoring board and a substantially atmospheric pressure acting on the bottom side thereof by draining liquid away from the underside of said anchoring board for discharge at said dry side, said draining means comprising one or more channels at said lower side of said anchoring board;

a liquid impervious damming board fastened to said anchoring board for orientation in an upright position for retaining said liquid on said wet side and preventing passage of said liquid from said wet side to said dry side, said damming board having upper, lower and side edges;

at least one connecting means between said anchoring board and damming board for holding said damming board in said generally upright position, wherein said at least one connecting means consist of one or more tensile force carrying connection devices which extend between the wet side of the damming board and the anchoring board, wherein the one or more tensile force carrying connection devices each comprise a generally plate-like web, and wherein said anchoring board and said damming board are interconnected in a liquid-proof way along a connection line which extends between a lower edge of the damming board and the top side of the anchoring board; and at least two of said tensile force carrying connection devices comprising two end surfaces each one of which includes a top part and an upright edge connected in a liquid-proof way to the damming board along said upright edge, as well as the anchoring board along a laying edge, all while forming a construction which is shovel-like and which, in an active state, opens towards the wet side, and further comprising sealing elements for sealing adjacent damming devices in an assembled protective bank, said sealing elements being applied to free edges of adjacent end surfaces of said tensile force carrying device to bridge space therebetween.

3. A damming device for forming a barrier between a wet or flood side and a dry side of said device, comprising:

an anchoring board for resting on a surface in a generally horizontal orientation, said anchoring board having top and bottom sides, and side, front and rear edges;

hydrostatic anchoring means associated with said board for anchoring said device to said surface by hydrostatic pressure, said anchoring means comprising in combination a barrier for limiting liquid seepage from said flood side underneath said anchoring board and draining means for maintaining a pressure differential between the hydrostatic pressure acting on said top side of said anchoring board and a substantially atmospheric pressure acting on the bottom side thereof by draining liquid away from the underside of said anchoring board for discharge at said dry side, said draining means comprising one or more channels at said lower side of said anchoring board;

a liquid impervious damming board fastened to said anchoring board for orientation in an upright position for retaining said liquid on said wet side and preventing passage of said liquid from said wet side to said dry side, said damming board having upper, lower and side edges;

at least one connecting means between said anchoring board and damming board for holding said damming board in said generally upright position, wherein said at least one connecting means consist of one or more tensile force carrying connection devices which extend between the wet side of the damming board and the anchoring board;

wherein said anchoring board and said damming board are interconnected in a liquid-proof way along a connection line which extends between a lower edge of the damming board and the top side of the anchoring board; and wherein a tensile force carrying connection device acting between the damming board and the anchoring board, consists of a bead formed as a continuous and cross section-wise arched part composed of said anchoring board and damming board each having an outwardly cambered portion extending upwardly and outwardly towards said wet side.

4. A damming device for forming a barrier between a wet or flood side and a dry side of said device, comprising:

an anchoring board for resting on a surface in a generally horizontal orientation, said anchoring board having top and bottom sides, and side, front and rear edges;

hydrostatic anchoring means associated with said board for anchoring said device to said surface by hydrostatic pressure, said anchoring means comprising in combination a barrier for limiting liquid seepage from said flood side underneath said anchoring board and draining means for maintaining a pressure differential between the hydrostatic pressure acting on said top side of said anchoring board and a substantially atmospheric pressure acting on the bottom side thereof by draining liquid away from the underside of said anchoring board for discharge at said dry side, said draining means comprising one or more channels at said lower side of said anchoring board;

a liquid impervious damming board fastened to said anchoring board for orientation in an upright position for retaining said liquid on said wet side and preventing passage of said liquid from said wet side to said dry side, said damming board having upper, lower and side edges;

at least one connecting means between said anchoring board and damming board for holding said damming board in said generally upright position; wherein said at least one connecting means consist of one or more tensile force carrying connection devices which extend between the wet side of the damming board and the anchoring board;

wherein said anchoring board and said damming board are interconnected in a liquid-proof way along a connection line which extends between a lower edge of the damming board and the top side of the anchoring board;

a tensile force carrying connection device acting between the damming board and the anchoring board, consists of a bead formed as a continuous and cross section-wise arched part composed of said anchoring board and damming board each having an outwardly cambered portion extending upwardly and outwardly towards said wet side; and each one of the two outwardly cambered portions narrows away from the connection line between the two boards.

5. A damming device for forming a barrier between a wet or flood side and a dry side of said device, comprising:

an anchoring board for resting on a surface in a generally horizontal orientation, said anchoring board having top and bottom sides, and side, front and rear edges;

hydrostatic anchoring means associated with said board for anchoring said device to said surface by hydrostatic pressure, said anchoring means comprising in combination a barrier for limiting liquid seepage from said flood side underneath said anchoring board and draining means for maintaining a pressure differential between the hydrostatic pressure acting on said top side of said anchoring board and a substantially atmospheric pressure acting on the bottom side thereof by draining liquid away from the underside of said anchoring board for discharge at said dry side, said draining means comprising one or more channels at said lower side of said anchoring board;

a liquid impervious damming board fastened to said anchoring board for orientation in an upright position for retaining said liquid on said wet side and preventing passage of said liquid from said wet side to said dry side, said damming board having upper, lower and side edges;

at least one connecting means between said anchoring board and damming board for holding said damming board in said generally upright position;

said at least one connecting means consist of one or more tensile force carrying connection devices which extend between the wet side of the damming board and the anchoring board;

said anchoring board and said damming board being interconnected in a liquid-proof way along a connection line which extends between a lower edge of the damming board and the top side of the anchoring board; and a tensile force carrying connection device acting between the damming board and the anchoring board, consists of a bead formed as a continuous and cross section-wise arched part composed of said anchoring board and damming board each having an outwardly cambered portion extending upwardly and outwardly towards said wet side;

said damming device includes a plurality of mutually parallel beads and the board portions outwardly cambered upwards formed in the anchoring board, mouth in a common collection channel which is defined by a board portion outwardly cambered upwards from the anchoring board which extends axially between the side edges of the anchoring boards.

6. A method for damming a liquid body, comprising the steps of:

providing a damming device for forming a fluid barrier between said liquid body and a dry side, said device comprising an anchoring board for resting on a surface beneath said liquid body having top and bottom surfaces, and a damming board fastened to said anchoring board, draining means for draining water away from the underside of said anchoring board, said means comprising at least one channel at the lower face of said anchoring board, a liquid barrier for limiting seepage of liquid from said liquid body underneath said anchoring board and connectors between said anchoring board and said damming board;

positioning said device on said surface;

anchoring said device to said surface by permitting said liquid to bear downwardly on said anchoring board, said anchoring board being of a sufficient size relative to said damming board for the frictional engagement of said anchoring board on said surface; and imposing a pressure of differential between the hydrostatic pressure acting on said top surface of said anchoring board and a substantially atmospheric pressure acting on said bottom surface thereof by removing liquid from the underside of said anchoring board, through said draining means.

* * * * *